US005912078A

United States Patent [19]

Schuette et al.

[11] Patent Number: 5,912,078

[45] Date of Patent: Jun. 15, 1999

[54] LUBRICANT FINISH FOR TEXTILES

[75] Inventors: Robert L. Schuette; Randy Dell Petrea, both of Spartanburg, S.C.

[73] Assignee: Milliken & Company, Spartanburg, S.C.

[21] Appl. No.: 08/640,619

[22] Filed: May 2, 1996

[51] Int. Cl.[6] ..... D02G 3/00

[52] U.S. Cl. ..... 428/375; 427/175; 427/389.9; 427/392; 427/401; 428/394; 428/395

[58] Field of Search ..... 252/8–84; 427/389.9, 427/393.2, 393.4, 392, 175, 401; 428/375, 394, 395

[56] References Cited

U.S. PATENT DOCUMENTS

| | | | |
|---|---|---|---|
| 3,850,682 | 11/1974 | Sturwold et al. | 252/8.84 X |
| 3,850,819 | 11/1974 | Shay | 252/8.84 |
| 4,816,336 | 3/1989 | Allou et al. | 252/8.84 X |

*Primary Examiner*—Michael Lusignan
*Attorney, Agent, or Firm*—Terry T. Moyer; Timothy J. Monahan

[57] ABSTRACT

A lubricant finish for high speed twisting of textile yarns is provided which incorporates an alkenyl succinic acid, or an anhydride, ester or salt of the acid.

20 Claims, No Drawings

LUBRICANT FINISH FOR TEXTILES

BACKGROUND OF THE INVENTION

This invention relates generally to the lubricating and conditioning of textile fibers, and more particularly to the use of alkenyl succinic anhydride derivatives as fiber surface frictional modifiers for use in conjunction with traditional lubricants. The lubricating composition is especially useful for high speed ply twisting.

Textile yarn is made from staple fibers or continuous filaments, such as BCF. The staple fibers may be natural, such as cotton, or synthetic polymers formed into continuous filaments by melt spinning which are then cooled and cut to length. Regardless of whether the yarns are made from natural or synthetic material, staple or continuous filaments, they can be severely damaged during the manufacturing operation. This is particularly evident today as machine speeds are being increased to lower manufacturing costs. Fiber finish plays a very important role in aiding processing by reducing friction, dissipating static charges and modifying the pliability and yarn bundle forming characteristics of the fibers. The composition and amount of finish applied depend largely upon the chemical composition of the fiber, the particular stage in the processing of the fiber, and the end use under consideration.

For example, compositions referred to as "spin finishes" are usually applied to textile fibers at the primary manufacturer's plant, after spinning. An additional finish, often called a "secondary finish" or "overspray", may be applied to the fiber directly before winding. While the primary finish helps with processing during fiber manufacture, the secondary finish is normally formulated to aid in subsequent textile operations, such as yarn manufacture at the mill site.

Acceptable finishes must fulfill a number of requirements in addition to providing lubrication and anti-static effects. For example, the finish should be easy to apply and remove, have good thermal, chemical, and storage stability, be easily removed from heated surfaces, and be biodegradable. Additionally, the finish should not interfere with dyeing, leave residues or varnish on surfaces, or generate toxic fumes.

Presently, fiber producers are applying greater than 1% finish to ply twisted carpet yarn, which includes both the primary finish and secondary finish. This is not only costly, but also creates problems for the yarn user. When the yarn is washed as part of the dyeing or scouring process, a high level of finish can create an environmental problem in the waste water treatment facility at the carpet makers location. Additionally, relatively high levels of finish add to manufacturing costs.

SUMMARY OF THE INVENTION

Therefore, one of the objects of the invention is to provide a fiber finish with superior lubricating properties. Another object of the invention is to provide a fiber finish which may be easily scoured from the textile yarn. Yet another object of the invention is to provide a fiber finish which will offer good frictional protection at low finish on yarn levels. Still another object is to provide a finish which performs well at relatively high processing speeds.

Accordingly, a lubricated textile yarn is provided having a surface application of from 0.01 to 10 weight percent per weight of the yarn of a finish formulation, wherein the finish is a blend of a conventional hydrodynamic lubricant and a friction modifier selected from alkenyl succinic acid, and anhydrides, esters, or salts thereof. Also within the scope of the invention is a method of making a plied yarn from a plurality of individual yarns having a surface application of the finish formulation. The finish is especially useful for high speed twisting operations.

In addition to meeting the forementioned objectives, the improved frictional performance allows for a decrease in the level of finish applied to the yarn, thereby decreasing the potential for negative environmental impact of the finish.

In alternative embodiments of the invention, one or more of the following features are included:

- the textile yarn is not heat textured;
- the textile yarn is not a bulk continuous filament (BCF) nylon or other fully oriented continuous filament yarn;
- the textile yarn is not a partially oriented polyamide or partially oriented polyester continuous filament yarn;
- the friction modifier is an n-$C_{10}$–$C_{18}$ alkenyl succinic acid, or anhydride, ester or salt of such alkenyl succinic acid;
- the friction modifier is an n-dodecenyl succinic acid, or anhydride, ester or salt of such acid; and
- a plurality of yarns treated with the fiber finish are plied at a speed of 4800 RPM or greater.

DETAILED DESCRIPTION OF THE INVENTION

Without limiting the scope of the invention, the preferred embodiment and features are hereinafter set forth. Unless otherwise indicated, all parts and percentages are by weight and conditions are ambient, i.e., one atmosphere of pressure and 25° C.

The term aryl is intended to be limited to single, fused double ring and biphenyl aromatic hydrocarbons. Unless otherwise specified, aliphatic hydrocarbons are from 1–12 carbons in length and the cycloaliphatic hydrocarbons comprise from 3–8 carbon atoms.

All the United States patents sited in this specification are hereby incorporated by reference.

The friction modifier is an alkenyl succinic acid, or anhydride ester, or salt of an alkenyl succinic acid, wherein the alkenyl group has from 2 to 40 carbon atoms, preferably 6 to 8 carbon atoms, and most preferably the alkenyl group is unbranched. Suitable friction modifiers are described by the formula:

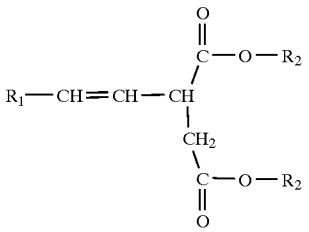

wherein $R_1$ is selected from hydrogen, $C_1$–$C_{38}$ alkyl, alkenyl, cycloalkyl, cycloalkenyl, aryl, alkylaryl or arylalkyl, preferably, $R_1$ is $C_6$ to $C_{16}$ alkyl, most preferably $C_8$ to $C_{16}$ alkyl; $R_2$ is independently selected, at each occurrence, from $R_1$ or a cationic counter ion, such as alkali metals, alkaline—earth metals, zinc, aluminum, ammonium and alkyl or alkanol substituted ammonio ions, wherein any of the hydrocarbon substituants may be substituted with an amino, group.

In general, the friction modifier may be synthesized by performing a ring-opening reaction with the corresponding alkenyl succinic anhydride with either an alcohol or any basic material or by neutralizing the free acid in situ in the spin finish formulation The friction modifier is incorporated into a lubricant finish in an amount from 1–99 weight percent of the finish composition, preferably 1–50 weight percent, most preferably 1–40 weight percent. Conventional hydrodynamic lubricants may be employed, such as mineral oil, vegetable oil, mono-, di-, tri-, tetra-, etc., esters of alcohols and polyhydric alcohols, polyalphaolefins, alkoxylated alcohols, fatty acids and esters thereof, alkyl polyether carboxylates and esters thereof, polyether copolymers, and silicones. The finish composition may also include a suitable antistatic agent, for example, anionic antistatic agents such as phosphates and sulfates of alcohol, ethoxylated alcohol, and potassium salts of phosphate esters; cationic antistatic agents such as quaternary ammonium compounds and imidazolines; nonionic antistatic agents such as poly(oxyalkylene) or polyglycerine derivatives; and amphoteric antistatic agents such as betaines.

Furthermore, the finish composition may incorporate emulsifiers, viscosity modifiers, low sling additives and water, as is well known to those skilled in the art.

The finish is applied to the surface of the textile yarn to achieve a pick up of from 0.03 to 10 weight percent, preferably from 0.05 to 1 weight percent based on the weight of the yarn. The finish may be applied to the yarn by any variety of known methods, including kiss roll, over spray, dipping, foaming and metering.

Suitable textile yarns include spun, monofilament and multifilament yarns. By way of example, spun yarns of polyamide, polyester, polyolefin, polyurethane, acrylic, and cellulosic fibers, such as cotton, rayon and acetate; and continuous filament yarn of polyamide, polyester, polyolefin, polyurethane, acrylic, rayon and acetate fibers.

The invention may be practiced with continuous multifilament yarns which are heat textured, such as fully oriented and partially oriented polyamide, such as BCF nylon, and polyester yarns.

In another embodiment of the invention, the lubricant is applied to yarns which have not been heat set and are not intended to be heat set, such as these spun yarns and continuous multifilament yarns selected from polyamide, polyester, polyolefin, polyurethane, acrylic, rayon and acetate fibers.

The finish of the present invention is particularly useful for high speed ply-twisting operations, in which a plurality of yarns are twisted into a plied yarn. The speed will vary according to the yarn employed, for example, spun yarns are typically ply-twisted at a speed of 3600 to 5000 RPM; continuous multifilament yarns are typically ply-twisted at a speed of 4800 to 7200 RPM and in particular, BCF nylon is ply-twisted at speeds of greater than 5800 RPM.

The invention may be further understood by reference to the following examples.

EXAMPLE I

Composition A

Octenyl succinic anhydride was added to an aqueous, 45% potassium hydroxide solution, and heated to form the di-potassium salt of 2- octenyl-1,4-butanedioic acid (the friction modifier). A lubricant, methyl 9 EO tallowate, and the friction modifier were mixed together to form a composition having a ratio of 19:1 by weight, respectively.

Composition B

Octenyl succinic anhydride was added to an aqueous, 45% potassium hydroxide solution, and heated to form the di-potassium salt of 2-octenyl-1,4-butanedioic acid (the friction modifier). A lubricant, methyl 9EO tallowate, and the friction modifier were mixed together to form a composition having a ratio of 9:1 by weight, respectively.

Composition C

Octenyl succinic anhydride was added to water and heated to form the corresponding di-acid. A lubricant methyl 9EO tallowate, was added to the di-acid to form a spin finish. The spin finish was added to water and the pH was adjusted with 45% potassium hydroxide to form the dipotassium salt of 2-octenyl-1,4-butanedioic acid. The ratio of the lubricant to the friction modifier was 4:1 by weight, respectively.

Composition D

Dodecenyl succinic anhydride was added to water and heated to form the corresponding di-acid. A lubricant, methyl 9EO tallowate, was added to the di-acid to form a spin finish. The spin finish was added to water and the pH was adjusted to a pH of 7.5 with 45% potassium hydroxide to form the dipotassium salt of 2-dodecenyl-1,4-butanedioic acid. The ratio of the lubricant to the friction modifier was 9:1 by weight, respectively.

Composition E

Dodecenyl succinic anhydride was added to water and heated to form the corresponding di-acid. A lubricant, methyl 9EO tallowate, was added to the di-acid to form a spin finish. The spin finish was added to water and the pH was adjusted to 7.5 with 45% potassium hydroxide to form the dipotassium salt of 2-dodecenyl-1,4-butanedioic acid. The ratio of the lubricant to the friction modifier was 4:1 by weight, respectively.

EXAMPLE II

For laboratory testing, the finish compositions (A–E) were applied to 70/34 (70 denier, 34 filament), nylon 6,6 dull flat yarn. The finish composition was applied as a 1.5% aqueous emulsion utilizing 50% pick-up to achieve a rate of 0.75 weight percent active finish based on the weight of the yarn. The yarns were then conditioned at 75° F. and 64% relative humidity.

Fiber-to-metal friction (F/M) was measured on a Rothchild Frictometer using a 0.316 inch polished chrome pin, with a contact angle of 75° and 20 grams of input tension. Fiber-to-fiber friction (F/F) was measured under the same conditions, except that two full twists were imparted to the yarn prior to testing.

The fiber-to-metal friction and the fiber-to-fiber friction were each measured at yarn speeds of 100 meters per minute to obtain both the hydrodynamic frictions. Hydrodynamic friction describes the amount of drag experienced as the yarn is being pulled across a substrate. During both the fiber-to-metal and the fiber-to-fiber friction evaluations, the output tension was measured and the coefficient of friction determined from the capstan equation:

$$T_2/T_1=e^{\mu\theta}$$

where $T_1$ and $T_2$ are the incoming and outgoing tensions respectively, θ the angle of contact in radians, and u the coefficient of friction. Some prefer to use the value of $T_2-T_1$ as a measurement of the frictional force since strictly speaking the capstan equation is not accurately obeyed by compressible materials such as fibers.

The effect of frictional and static properties is generally obvious throughout fiber manufacture and processing. Fiber to fiber friction is important to the fiber producer in controlling formation and stability of filament yarn packages since sloughing can occur if it is too low. Also, if fiber to fiber friction is too low, there could be problems of poor web cohesion in carding of staple fibers. On the other hand, low fiber to fiber friction is very desirable for continuous filament yarns which are used in applications such as cordage which involves twisting and plying. Low friction is desirable since it is associated with high flex resistance and high energy absorption and therefore, long life. Fiber to metal friction is also very important in many of the fiber processes. Lower fiber to metal friction is generally preferred since there is less opportunity for damage to the fibers either by abrasion or heat generation as the yarn contacts metal surfaces.

Table 1 lists the output tensions of fiber/metal and fiber/fiber hydrodynamic friction of the compositions of Example 1 as compared to the lubricant alone. Typically, finish compositions with lower fiber/metal frictional coefficients, i.e. lower output tensions, as measured on the frictometer, perform much better than their higher friction coefficient counterparts in ply-twisting; they dust less, have little or no ring deposits, and fewer, if any, broken filaments.

TABLE 1

Yarn/Metal and Yarn/Yarn Frictometer Measurements

| FINISH | FIBER/METAL LOW OUTPUT TENSION, g | FIBER/METAL HIGH OUTPUT TENSION, g | FIBER/FIBER LOW OUTPUT TENSION, g | FIBER/FIBER HIGH OUTPUT TENSION, g |
|---|---|---|---|---|
| LUBRICANT | 58.00 | 62.00 | 41.00 | 43.00 |
| COMPOSITION A | 63.00 | 66.00 | 42.00 | 44.00 |
| COMPOSITION B | 66.00 | 70.00 | 44.00 | 46.00 |
| COMPOSITION C | 68.00 | 72.00 | 48.00 | 51.00 |
| COMPOSITION D | 64.00 | 68.00 | 45.00 | 47.00 |
| COMPOSITION E | 68.00 | 72.00 | 45.00 | 48.00 |

EXAMPLE III

In the following twisting example, 1210 denier bulked continuous filament (BCF) nylon 6 carpet yarn was used in the creel on a wide-gauge Volkmann twister (Model No. VTS 050 C). The finish compositions of Example I were applied to the yarn directly after extrusion via a kiss roll. The level of finish on the yarn (FOY) was determined using a soxhlett extraction technique and found to be 0.40±0.02%. The wide-gauge Volkmann twister was run at 7800 RPM storage disc speed with 5.5 turns per inch setting for several hours. Observations were made during the ply twisting operation and reported in Table 2.

TABLE 2

Ply Twisting Performance

| COMPOSITION | ALKYL CHAIN | LUBRICANT TO FRICTION MODIFIER | OBSERVATIONS DURING PLY TWISTING |
|---|---|---|---|
| A | 8 | 19:1 | HEAVY DUSTING, HEAVY DEPOSITS |
| B | 8 | 9:1 | SLIGHT DUSTING, SLIGHT DEPOSIT |
| C | 8 | 4:1 | NO DUSTING, NO DEPOSITS |
| D | 12 | 9:1 | SLIGHT DUSTING, NO DEPOSITS |
| E | 12 | 4:1 | NO DUSTING, NO DEPOSITS |

As can be seen from the frictometer measurements and the accompanying twisting observations, the performance of the examples is completely unexpected. Based on the frictometer measurements, one would expect the opposite performance of what was actually witnessed. One would expect A>D>B>C=E in ply twisting performance as measured by the amount of dusting and ring deposits. However, just the opposite was observed.

EXAMPLE IV

The following examples were run employing anhydrides with varying carbon chain alkenyl groups, at various concentrations of anhydride salts in the lubricant, and at various % finish on yarn. The results are in Table 3.

Composition AA HIGH % FOY

To 3200 grams of water was added 800 grams of methyl 9EO tallowate. The emulsion was further diluted and applied to 1210 denier BCF nylon 6 for a target level of 1.1% FOY.

Composition AA—LOW % FOY

To 3200 grams of water was added 800 grams of methyl 9EO Tallowate. The emulsion was further diluted and applied to 1210 denier BCF nylon 6 for a target level of 0.55% FOY.

Composition BB—HIGH % FOY

To 3113.8 grams of water was added 740 grams of methyl 9EO tallowate and 146.2 grams of a 41.04% active solution of the dipotassium salt of 2-tetrapropenyl-1,4-butenedioic acid. as prepared in Example I-A. The emulsion was further diluted and applied to 1210 denier BCF nylon 6 for a target level of 0.8% FOY.

Composition BB—LOW %FOY

To 3113.8 grams of water was added 740 grams of methyl 9EO tallowate and 146.2 grams of a 41.04% active solution of the dipotassium salt of 2-tetrapropenyl-1,4-butenedioic acid. The emulsion was further diluted and applied to 1210 denier BCF nylon 6 for a target level of 0.3% FOY.

Composition CC—HIGH % FOY

To 3027.6 grams of water was added 680 grams of methyl 9EO tallowate and 292.4 grams of a 41.04% active solution of the dipotassium salt of 2-tetrapropenyl-1,4-butenedioic acid. The emulsion was further diluted and applied to 1210 denier BCF nylon 6 for a target level of 0.8% FOY.

Composition CC—LOW %FOY

To 3027.6 grams of water was added 680 grams of methyl 9EO tallowate and 292.4 grams of a 41.04% active solution of the dipotassium salt of 2-tetrapropenyl-1,4-butenedioic acid. The emulsion was further diluted and applied to 1210 denier BCF nylon 6 for a target level of 0.3% FOY.

Composition DD—HIGH % FOY

To 3056.7 grams of water was added 740 grams of methyl 9EO tallowate and 203.3 grams of a 29.52% active solution of the dipotassium salt of 2-dodecenyl-1,4-butanedioic acid as prepared in Example I-D. The emulsion was further diluted and applied to 1210 denier BCF nylon 6 for a target level of 0.8% FOY.

Composition DD—LOW %FOY

To 3027.6 grams of water was added 680 grams of methyl 9EO tallowate and 292.4 grams of a 29.52% active solution of the dipotassium salt of 2-dodecenyl-1,4-butanedioic acid. The emulsion was further diluted and applied to 1210 denier BCF nylon 6 for a target level of 0.3% FOY.

Composition EE—HIGH % FOY

To 2913.5 grams of water was added 680 grams of methyl 9EO tallowate and 406.5 grams of a 29.52% active solution of the dipotassium salt of 2-dodecenyl-1,4-butanedioic acid. The emulsion was further diluted and applied to 1210 denier BCF nylon 6 for a target level of 0.8% FOY.

Composition EE—LOW %FOY

To 2913.5 grams of water was added 680 grams of methyl 9EO tallowate and 406.5 grams of a 29.52% active solution of the dipotassium salt of 2-dodecenyl-1,4-butanedioic acid. The emulsion was further diluted and applied to 1210 denier BCF nylon 6 for a target level of 0.3% FOY.

Composition FF—HIGH % FOY

To 3056.1 grams of water was added 740 grams of methyl 9EO tallowate and 203.9 grams of a 29.43% active solution of the dipotassium salt of 2-octenyl-1,4-butanedioic acid prepared according to Example I-A. The emulsion was further diluted and applied to 1210 denier BCF nylon 6 for a target level of 0.8% FOY.

Composition FF—LOW %FOY

To 3056.1 grams of water was added 740 grams of methyl 9EO tallowate and 203.9 grams of a 29.43% active solution of the dipotassium salt of 2-octenyl-1,4-butanedioic acid. The emulsion was further diluted and applied to 1210 denier BCF nylon 6 for a target level of 0.3% FOY.

Composition GG—HIGH % FOY

To 2912.3 grams of water was added 680 grams of methyl 9EO tallowate and 407.7 grams of a 29.43% active solution of the dipotassium salt of 2-octenyl-1,4-butanedioic acid. The emulsion was further diluted and applied to 1210 denier BCF nylon 6 for a target level of 0.8% FOY.

Composition GG—LOW %FOY

To 2912.3 grams of water was added 680 grams of methyl 9EO tallowate and 407.7 grams of a 29.43% active solution of the dipotassium salt of 2-octenyl-1,4-butanedioic acid. The emulsion was further diluted and applied to 1210 denier BCF nylon 6 for a target level of 0.3% FOY.

Composition HH—HIGH % FOY

To 2432.7 grams of water was added 480 grams of methyl 9EO tallowate and 1087.3 grams of a 29.43% active solution of the dipotassium salt of 2-octenyl-1,4-butanedioic acid. The emulsion was further diluted and applied to 1210 denier BCF nylon 6 for a target level of 0.8% FOY.

Composition HH—LOW %FOY

To 2432.7 grams of water was added 480 grams of methyl 9EO tallowate and 1087.3 grams of a 29.43% active solution of the dipotassium salt of 2-octenyl-1,4-butanedioic acid. The emulsion was further diluted and applied to 1210 denier BCF nylon 6 for a target level of 0.3% FOY.

The compositions AA–HH are summarized in Table 3 below.

TABLE 3

Composition Summary

| COMPOSITION | ALKENE | % ASA SALT in FORMULA | TOTAL TARGET % FOY | TOTAL ASA FOY | MEASURED % FOY |
|---|---|---|---|---|---|
| AA - HIGH | — | 0.00 | 1.10 | 0.00 | 1.09 |
| AA - LOW | — | 0.00 | 0.55 | 0.00 | 0.37 |
| BB - HIGH | TETRAMER | 7.50 | 0.80 | 0.06 | 0.73 |
| BB - LOW | TETRAMER | 7.50 | 0.30 | 0.02 | 0.32 |
| CC - HIGH | TETRAMER | 15.00 | 0.80 | 0.12 | 0.78 |
| CC - LOW | TETRAMER | 15.00 | 0.30 | 0.05 | 0.32 |
| DD - HIGH | n-DODECENE | 7.50 | 0.80 | 0.06 | 0.81 |
| DD - LOW | n-DODECENE | 7.50 | 0.30 | 0.02 | 0.30 |
| EE - HIGH | n-DODECENE | 15.00 | 0.80 | 0.12 | 0.76 |
| EE - LOW | n-DODECENE | 15.00 | 0.30 | 0.05 | 0.27 |
| FF - HIGH | OCTENE | 7.50 | 0.80 | 0.06 | 0.88 |
| FF - LOW | OCTENE | 7.50 | 0.30 | 0.02 | 0.33 |
| GG - HIGH | OCTENE | 15.00 | 0.80 | 0.12 | 0.61 |
| GG - LOW | OCTENE | 15.00 | 0.30 | 0.05 | 0.25 |
| HH - HIGH | OCTENE | 40.00 | 0.80 | 0.32 | 0.43 |
| HH - LOW | OCTENE | 40.00 | 0.30 | 0.12 | 0.24 |

EXAMPLE V

The yarn that was formed in compositions AA through HH was aged for three weeks and twisted. In the twisting examples, 1210 denier bulked continuous filament (BCF) nylon 6 carpet yarn was used in the creel on a wide-gauge Volkmann twister (Model No. VTS 050 C). For each of the compositions, the finish was applied to the yarn directly after extrusion via a kiss roll. The level of finish on yarn (FOY) was determined using a soxhlett extraction technique. The wide-gauge Volkmann twister was run at 6800 to 8000 rpm storage disc speed with 5.5 turns per inch setting for several hours until heavy dusting was observed. Observations were made at various time intervals during the ply twisting operation and reported in Table 4 and Table 5 below. The time during which the yarn ran at a particular rate without a problem is reported in hours. The performance was rated on a scale of 1 to 8 (1 being the best) according to the maximum RPM reached and time at that speed, before heavy dusting and deposits were formed.

TABLE 4

| | | Low Finish Ply Twisting | | | | | |
|---|---|---|---|---|---|---|---|
| COMPO-SITIONS | ALKENE | % ASA SALT | 6800 RPM HOURS | 7200 RPM HOURS | 7400 RPM HOURS | 7800 RPM HOURS | RATING (1–8) 1 = BEST |
| AA - LOW | — | 0.00 | 0.25 | 0.00 | 0.00 | 0.00 | 8 |
| BB - LOW | TETRAMER | 7.50 | 2.50 | 1.50 | 0.50 | 0.00 | 6 |
| CC - LOW | TETRAMER | 15.00 | 0.75 | 0.00 | 0.00 | 0.00 | 7 |
| DD - LOW | n-DODECENE | 7.50 | 2.50 | 1.50 | 1.00 | 4.50 | 1 |
| EE - LOW | n-DODECENE | 15.00 | 2.50 | 1.50 | 1.00 | 4.50 | 1 |
| FF - LOW | OCTENE | 7.50 | 2.50 | 1.50 | 1.00 | 2.50 | 5 |
| GG - LOW | OCTENE | 15.00 | 2.50 | 1.50 | 1.00 | 3.50 | 4 |
| HH - LOW | OCTENE | 40.00 | 2.50 | 1.50 | 1.00 | 4.50 | 1* |

*Slight dusting was witnessed on the HH sample that was not present in Examples EE and FF.

TABLE 5

| | | High Finish Ply Twisting | | | | | |
|---|---|---|---|---|---|---|---|
| COMPO-SITIONS | ALKENE | % ASA SALT | 7200 RPM HOURS | 7600 RPM HOURS | 7800 RPM HOURS | 8000 RPM HOURS | RATING (1–8) 1 = BEST |
| AA - HIGH | — | 0.00 | 6.00 | 0.00 | 0.00 | 0.00 | 8 |
| BB - HIGH | TETRAMER | 7.50 | 6.00 | 2.00 | 4.00 | 12.00 | 1 |
| CC - HIGH | TETRAMER | 15.00 | 6.00 | 2.00 | 4.00 | 12.00 | 1 |
| DD - HIGH | n-DODECENE | 7.50 | 6.00 | 2.00 | 4.00 | 12.00 | 1 |
| EE - HIGH | n-DODECENE | 15.00 | 6.00 | 2.00 | 4.00 | 12.00 | 1 |
| FF - HIGH | OCTENE | 7.50 | 6.00 | 2.00 | 4.00 | 12.00 | 1 |
| GG - HIGH | OCTENE | 15.00 | 6.00 | 2.00 | 4.00 | 12.00 | 1 |
| HH - HIGH | OCTENE | 40.00 | 6.00 | 2.00 | 4.00 | 12.00 | 1* |

*slight dusting not witnessed with the other candidates.

As can be seen from the twisting results, the performance of the anhydride salts is such that n-dodecenyl provides greater frictional protection than n-octenyl, which is better than tetrapropenyl. Also, while increased levels of ASA give higher friction measurements in the laboratory which would indicate poorer cabling performance; the converse is true. The twisting performance improved with increased ASA salts.

EXAMPLE VI

Composition PET 1

In this example, 1185 denier BCF polyester carpet yarn was prepared with a spin finish of the dipotassium salt of 2-octenyl-1,4-butanedioic acid as prepared in Example I and an overfinish of Lubestat 2276, an ester based finish available from Milliken Chemical, Spartanburg, S.C. The over-all target finish level was 1%, 0.4% spin finish and 0.6% overfinish.

Composition PET 2

In this example, 1185 denier BCF polyester carpet yarn was prepared with a spin finish of Lubestat 2276 and an overfinish of Lubestat 2276. The over-all target finish level was 1%, 0.4% spin finish and 0.6% overfinish.

In the twisting examples, the 1185 denier bulked continuous filament (BCF) polyester carpet yarn was used in the creel on a Volkmann twister (Model No. VTS-050). In each of the examples, the spin finish was applied to the yarn directly after extrusion via a kiss roll with a target %FOY level of 0.4%. The overfinish was applied via a metering pump with a target level of 0.6%. The Volkmann twister was run from 3700 to 4000 rpm storage disc speed with 5.0 turns per inch setting for several hours. Observations were made during the ply twisting operation and reported in Table 6, and the compositions were rated on a scale of 1 to 8 (1 being the best).

TABLE 6

| | | Polyester Yarn Ply Twisting | | |
|---|---|---|---|---|
| COMPOSITION | % ASA | TIME @ 3700 RPM, HR | TIME @ 4000 RMP, HR | RATING |
| PET1 | 0.40 | 2.75 | 0.50 | 1 |
| PET2 | 0.00 | 0.10 | 0.00 | 2 |

EXAMPLE VII

To nylon industrial yarn was added a spin finish solution of Syn Lube 6138 available from Milliken Chemical, Spartanburg S.C., and the dipotassium salt of 2-octenyl-1,4-butanedioic acid, as prepared in Example I (the ASA Finish) and compared directly with a typical commercial nylon industrial finish (Standard Finish). The processing results are recorded in Table 7.

TABLE 7

Nylon Industrial Yarn Ply Twisting

| FINISH | % ASA | RUN TIME | BREAKS | BROKEN FILAMENTS |
|---|---|---|---|---|
| ASA | 5 | 80 HOURS | 5 | 4 |
| STANDARD | 0 | 36 HOURS | >10 | >10 |

EXAMPLE VIII

ASA FINISH

In this example, polyester staple for carpet yarn was oversprayed with an ester based finish containing the dipotassium salt of 2-octenyl-1,4-butanedioic acid prepared according to Example I-C. The overspray target add on was 0.3%. The fiber was then ring-spun and evaluated on a Volkmann twister (Model No. VTS 050).

STANDARD FINISH

In this example, polyester staple for carpet yarn was oversprayed with an ester based finish, Lubestat 2276, for a target add on of 0.3%. The fiber was then ring-spun and evaluated on a Volkmann twister (Model No. VTS 050).

The results of the twisting trial are reported in Table 8 and rated on a scale of 1 to 8 (1 being the best).

TABLE 9

Polyester Staple Ply Twisting

| FINISH | % ASA | MAXIMUM TWISTING SPEED | RATING |
|---|---|---|---|
| ASA | 0.03 | 6400 RPM | 1 |
| STANDARD | 0.00 | 6000 RPM | 2 |

There are, of course, many obvious alternate embodiments and modifications of the invention, which are intended to be included within the scope of the following claims.

What we claim is:

1. An article comprising a textile yarn and a finish applied to the surface of the yarn, wherein the finish incorporates a lubricant and a friction modifier selected from the group consisting of n-$C_{10}$ to $C_{18}$ alkenyl succinic acid and the anhydride, $C_{1-38}$ alkyl esters and salts of alkenyl succinic acid.

2. The article of claim 1 wherein the finish is applied to the yarn at a level of from 0.05 to 1 weight percent based on the weight of the yarn.

3. The article of claim 2 wherein the textile yarn is selected from the group consisting of:

(a) spun yarns of polyamide, polyester, polyolefin, polyurethane, acrylic and cellulosic fibers; and (b) continuous filament yarns of polyamide, polyester, polyolefin, polyurethane, acrylic, rayon and acetate fibers.

4. The article of claim 1 wherein the friction modifier is an ester or salt of n-dodecenyl succinic acid.

5. The article of claim 1 wherein the finish further comprises a lubricant selected from the group consisting of mineral oil, vegetable oil, mono-, di-, tri-, tetra-, etc., esters of alcohols and polyhydric alcohols, polyalphaolefins, alkoxylated alcohols, fatty acids and esters thereof, alkyl polyether carboxylates, and esters thereof polyether copolymers, and silicones.

6. The article of claim 5 wherein the textile yarn is selected from the group consisting of yarns of polyolefin, polyurethane, acrylic and cellulosic fibers.

7. An article comprising a textile yarn and a finish applied to the surface of the yarn, wherein the finish incorporates a lubricant and a friction modifier selected from the group consisting of alkenyl succinic acid and the anhydride, $C_{1-38}$ alkyl esters and salts of alkenyl succinic acid and the textile yarn is selected from the group consisting of:

(a) spun yarns of polyamide, polyester, polyolefin, polyurethane, acrylic and cellulosic fibers; and (b) continuous filament yarns of polyolefin, polyurethane, acrylic, rayon and acetate fibers.

8. The article of claim 7 wherein the finish is applied to the yarn at a level of from 0.03 to 10 weight percent based on the weight of the yarn.

9. The article of claim 7 wherein the alkenyl component of the friction modifier is selected from the group consisting of unbranched $C_{10}$ to $C_{18}$ alkenyl groups and the friction modifier is a salt of alkenyl succinic anhydride.

10. The article of claim 7 wherein the friction modifier is an ester or salt of n-dodecenyl succinic acid.

11. A method of making a plied yarn comprising the steps of:

(a) applying to a plurality of yarns, from 0.05 to 1 weight % based on the weight of each yarn, of a lubricant finish incorporating a friction modifier selected from the group consisting of alkenyl succinic acid and the anhydride, $C_{1-38}$ esters and salts of alkenyl succinic acid; and (b) twisting the yarns at high speed to form the plied yarn.

12. The method of claim 11 wherein the textile yarn is selected from the group consisting of:

(a) spun yarns of polyamide, polyester, polyolefin, polyurethane, acrylic and cellulosic fibers; and (b) continuous filament yarns of polyolefin, polyurethane, acrylic, rayon and acetate fibers.

13. The method of claim 11 wherein the textile yarn is selected from the group consisting of yarns of polyolefin, polyurethane, acrylic and cellulosic fibers.

14. The method of claim 11 wherein the alkenyl component of the friction modifier is selected from the group consisting of unbranched $C_{10}$ to $C_{18}$ alkenyl groups and the friction modifier is a salt of alkenyl succinic anhydride.

15. The method of claim 11 wherein the friction modifier is an ester or salt of n-dodecenyl succinic acid.

16. The method of claim 11 wherein the textile yarn has not been heat textured.

17. The method of claim 16 wherein the yarn is twisted at a speed of 4800 meters per minute or greater.

18. The method of claim 11 wherein the textile yarn is twisted at a speed of 4800 meters per minute or greater.

19. The method of claim 18 wherein the textile yarn is selected from the group consisting of:

(a) spun yarns of polyamide, polyester, polyolefin, polyurethane, acrylic and cellulosic fibers; and (b) continuous filament yarns of polyolefin, polyurethane, acrylic, rayon and acetate fibers.

20. The method of claim 18 wherein the textile yarn is not a partially oriented, continuous filament polyamide nor a partially oriented, continuous filament polyester yarn.

* * * * *